US010377031B2

(12) United States Patent
Wood

(10) Patent No.: US 10,377,031 B2
(45) Date of Patent: Aug. 13, 2019

(54) KNIFE WITH INTEGRAL HOLLOW TANG

(71) Applicant: Andrew Wood, Braintree (GB)

(72) Inventor: Andrew Wood, Braintree (GB)

( * ) Notice: Subject to any disclaimer, the term of this patent is extended or adjusted under 35 U.S.C. 154(b) by 538 days.

(21) Appl. No.: 14/780,005

(22) PCT Filed: Mar. 27, 2014

(86) PCT No.: PCT/GB2014/050980
§ 371 (c)(1),
(2) Date: Sep. 25, 2015

(87) PCT Pub. No.: WO2014/155122
PCT Pub. Date: Oct. 2, 2014

(65) Prior Publication Data

US 2016/0046017 A1 Feb. 18, 2016

(30) Foreign Application Priority Data

Mar. 28, 2013 (GB) ..... 1305736.9
Dec. 18, 2013 (GB) ..... 1322459.7

(51) Int. Cl.
*B25G 3/02* (2006.01)
*B26B 3/00* (2006.01)
(Continued)

(52) U.S. Cl.
CPC ..... *B25G 3/02* (2013.01); *B26B 3/00* (2013.01); *B26B 3/02* (2013.01); *B26B 3/06* (2013.01); *B26B 11/00* (2013.01); *F41B 13/08* (2013.01)

(58) Field of Classification Search
CPC .... B25G 3/02; B25G 1/00; B25G 1/08; B26B 3/00; B26B 3/02; B26B 3/06;
(Continued)

(56) References Cited

U.S. PATENT DOCUMENTS 169,324 A * 10/1875 Williams ..... B25G 1/00 279/99
363,401 A * 5/1887 Lee ..... B26B 3/02 220/755
(Continued)

FOREIGN PATENT DOCUMENTS

DE 694653 7/1940
DE 1 076 529 * 2/1960 ..... B26B 3/06
(Continued)

OTHER PUBLICATIONS

Outdoor Community Survivalist, 5 pages, Survival Equipment Store.
(Continued)

*Primary Examiner* — Clark F Dexter
(74) *Attorney, Agent, or Firm* — Renner Kenner Greive Bobak Taylor & Weber

(57) ABSTRACT

A knife 10 includes a blade 12 and an integral hollow tang 17 configured to accommodate items therein. At least one rib 25, 26 projects outwardly from at least part of the hollow tang 17 and extends axially at least part way along the tang 17. One or more separately formed handle components 30 is mounted on the tang 17 and connected to the at least one rib 25, 26.

9 Claims, 6 Drawing Sheets

(51) Int. Cl.

| | |
|---|---|
| ***B26B 3/02*** | (2006.01) |
| ***B26B 3/06*** | (2006.01) |
| ***B26B 11/00*** | (2006.01) |
| ***F41B 13/08*** | (2006.01) |

(58) Field of Classification Search
CPC ... B26B 11/00; B26B 3/03; B26B 3/08; F41B 13/00; F41B 13/08; F41B 15/08
USPC ..... 30/340, 342, 343, 344, 142, 146–150; 76/106, 104.1
See application file for complete search history.

(56) References Cited

U.S. PATENT DOCUMENTS 638,555 A * 12/1899 Burton ..... B26B 5/001 206/102
939,346 A * 11/1909 Sterling ..... B25G 1/00 279/99
1,611,886 A * 12/1926 Champlin ..... B26B 3/06 30/125
1,632,227 A * 6/1927 Halsey ..... B25G 1/105 16/421
2,545,121 A * 3/1951 Szopa ..... B26B 3/06 224/232
2,651,106 A * 9/1953 Breitzke ..... B26B 3/06 30/125
2,941,292 A * 6/1960 Mirando et al. ..... B26B 3/02 30/165
3,114,973 A 12/1963 Kennedy
3,760,438 A * 9/1973 White ..... B25F 1/02 30/143
4,387,510 A 6/1983 Hashemifard
4,541,314 A * 9/1985 Korkowski ..... B25B 15/04 81/436
4,669,186 A * 6/1987 Liu ..... B26B 11/008 30/125
6,029,315 A * 2/2000 Flower ..... B25B 15/02 16/422
6,336,731 B1 * 1/2002 Chien ..... A47J 43/28 362/120
6,419,371 B1 * 7/2002 McCalla et al. ..... B25B 23/18 362/120
6,434,836 B1 * 8/2002 Olivares ..... B26B 7/00 30/125
7,360,914 B2 * 4/2008 Kim ..... F21V 33/0064 362/109
7,856,910 B2 * 12/2010 Kwok ..... B26B 3/00 16/111.1
2003/0112622 A1 * 6/2003 Chu et al. ..... A01K 97/18 362/109
2003/0221323 A1 * 12/2003 DeAsis et al. ..... B25G 3/32 30/329
2004/0198173 A1 * 10/2004 Shulman et al. .... A63B 69/004 446/473
2005/0229406 A1 * 10/2005 Lai ..... A47G 21/02 30/324
2006/0123600 A1 * 6/2006 Morse ..... B25G 1/005 16/421
2007/0204471 A1 * 9/2007 Castagna ..... B26B 5/00 30/342
2010/0005667 A1 * 1/2010 Weigl, Jr. ..... A47G 21/02 30/142
2012/0047744 A1 * 3/2012 Walters ..... A47G 21/06 30/142

FOREIGN PATENT DOCUMENTS

| | | | | |
|---|---|---|---|---|
| DE | 4442274 | | 5/1996 | |
| EP | 3 170 717 | A1 * | 5/2017 | ..... B26B 3/00 |
| FR | 839.272 | * | 3/1939 | ..... B26B 3/00 |
| FR | 2560804 | | 9/1985 | |
| GB | 2153283 | | 8/1985 | |

OTHER PUBLICATIONS

Intellectual Property Office, www.ipo.gov.uk, 3 pages, Sep. 4, 2014 Search Report Under 17(5).

* cited by examiner

KNIFE WITH INTEGRAL HOLLOW TANG

This invention relates to a knife and in particular to a knife having an integral hollow tang. The invention also extends to a kit of parts including such a knife and a range of interchangeable handles for connection thereto.

The term tang as used herein means the extension of a knife blade which serves to connect the blade to a separate handle. Different types of tangs exist but generally they fall into one of two categories; full tangs or partial tangs. A full tang extends along the full length of a connected knife handle whereas a partial tang will not. The handle connected to a partial tang knife will extend beyond the length of the tang. Knives are available in a range of different shapes and styles, depending predominately on their intended function. The present invention is directed towards survival knives and so is described herein with a particular emphasis on such use. It will be appreciated though that the knife of the present invention is not limited to such use and may be used for other purposes.

Some survival knives have a cavity formed within the handle in which items, such as firesteel rods, sharpening rods or other survival accessories may be stored. Typically, hollow handle knives comprise a partial tang connecting the blade to the hollow handle. The drawback of such knives is that they can weaken over time and so are often avoided. This is primarily due to the tang having to be sufficiently small in length so as to allow sufficient storage space within the hollow handle. The area where the tang intersects the handle creates a weak point and makes these knives inherently susceptible to breakage. Additionally, due to the shape and configuration of the partial tang, the type of handle which can be used on such knives is usually limited.

It is desirable to have a storage cavity but without compromising the strength, integrity and life of the knife. To address this, knives have been developed having a hollow handle which is integral to the blade, removing the requirement for a tang altogether. In principle this appears to be ideal and indeed this type of arrangement can provide a long lasting and structurally strong knife. However, these types of knives also suffer from disadvantages. The storage space within the handle needs to be sufficiently large in order to serve its purpose but difficulties in the manufacture of a knife having a blade which is integral to a hollow handle have resulted in the handle being inherently large. This can be dangerous as it makes handling of the knife very difficult, particularly where the user is wearing gloves or in extreme weather conditions. The larger the integral handle the heavier the knife which could be problematic in terms of holding capacity and ease of use. Additionally, the weight of the integral handle also affects the balance of the knife.

Moreover, typically the blade of a knife is formed from a cylindrical metal rod and thus the handle, being integral, is also formed from metal; metal is a very good heat conductor and so the knife would not be suitable in extremely hot or extremely cold conditions or indeed in conditions where the temperature varies considerably. Due to the inherent large size of the round handle, the application of a separate handle member to the base handle would only enhance the safety problems, if indeed it were possible to secure a handle to the knife; since there is no tang, there is no component to which a handle could be secured. It is important that the storage compartment is not exposed to the environment and so openings through the handle for the application of securing screws would not provide a feasible solution.

It is a principal aim of the present invention to provide a knife which addresses at least some of the above problems, and which includes a storage cavity without compromising strength, integrity or usability.

According to this invention, there is provided a knife comprising:

- a blade;
- a hollow tang integral with the blade and configured to accommodate items therein;
- at least one rib projecting outwardly from at least part of the hollow tang, the rib extending axially at least part way along the tang; and
- one or more separately formed handle components mounted on the tang and connected to the at least one rib.

An important distinction between the knife of the present invention and the prior art knives is that in the present invention the tang of the knife is hollow and not the handle per se. Of course, the handle to be connected to the knife will need to be hollow when considered as a distinct separate component but assembled as a finished article the handle will embrace the tang.

The at least one rib may be a separate component securely connected to the tang. A join of any kind is a weakness and so preferably the at least one rib and the hollow tang are integral. More preferably, for maximum strength and to ensure that the knife is sturdy and robust, the at least one rib is defined as an extension of the blade. In this way, the blade and the at least one rib form a single continuous surface of the knife.

The outer periphery of the tang, excluding the at least one rib or ribs, may be generally cylindrical, with the hollow tang being generally annular in cross section. While other shapes of tang are equally applicable, a circular-type shape is likely to be adopted as this will typically correspond to the shape of a connected handle. The tang may be made hollow by the formation of a substantially cylindrical recess through one end thereof, thereby defining the generally annular shape.

The at least one rib may be substantially elongate some or most of the way along the tang, thereby forming a flange for connection of the one or more handle components thereto.

The at least one rib may taper away from the hollow tang so that the thickness narrows as the rib projects further outward from the tang. Additionally or alternatively, the at least one rib may taper towards the end thereof remote from the blade. By narrowing the rib, the weight of the knife may be reduced at the rear thereof.

Preferably, there are two ribs projecting from opposed parts of the tang. The ribs may extend from substantially diametrically opposed parts of the tang. The provision of two ribs on opposed sides of the tang may be advantageous in ensuring that the rear of the knife, i.e. the part of the knife remote from the blade, is balanced as well as increasing the overall strength of the knife and connection with the handle component(s). There may be more than two ribs projecting from the tang and such an arrangement would fall within the scope of this invention.

Various types of tang styles and handle arrangements may be incorporated into a knife of the present invention. The or each rib may be generally rectangular in axial cross section, though the rib(s) may be configured in any shape suitable for the intended use of the knife and the type of handle to be connected. The rib(s) may extend only part way along the tang or all the way along. Alternatively, the rib(s) may extend outwardly and intermittently from the tang.

The tang may have a recess formed therein, as discussed above, for storing items such as matchsticks or other survival accessories. This recess may have an internal thread and the knife may include an end cap having an external thread configured to engage the internal thread of the recess, to close the recess. The end cap preferably seals the opening and protects the contents of the recess. The end cap is preferably configured to allow easy access to the recess. To achieve this, the end cap may extend outwardly from the recess to provide a grip region. Alternatively, a handle member may be pivotally connected to the end cap to facilitate screw threaded engagement with the tang. In another arrangement, the end cap and recess are configured to allow frictional engagement of the end cap therein.

The blade, tang and rib(s) may be formed from a strong metal such as steel or carbon steel. The handle may be formed from any suitable material, which may vary depending on intended use and/or temperature conditions, but may include a hard rubber or polymer.

The handle may be configured so that one or more rib is exposed along the longitudinal length. In this arrangement, the shape and configuration of the interior of the one or more handle components may be complementary to the tang such that at least part of the rib is exposed. This may assist a user in identifying whether the knife has a partial, full or some other type of tang. Alternatively, the shape and configuration of the inside face of the one or more handle components may be complementary to the tang and the at least one rib. This type of arrangement enables the handle to encapsulate the rib(s) and ensure that the tang and rib structure is hidden. The tang may be a full tang, extending the entire length of the handle or may be a partial tang.

According to a second but closely related embodiment of this invention there is provided a kit of parts for forming a knife comprising:

a blade having an integral hollow tang;

at least one rib projecting outwardly from at least part of the hollow tang, the rib extending axially at least part way along the tang; and one or more separately formed handle components configured for mounting on the tang and for connecting to the at least one rib.

The kit of parts comprises the knife as described above but essentially without the one or more handle components mounted to the tang. The user may choose to connect the handle components supplied with the kit or another type of handle. In this regard the kit may further comprise one or more additional separately formed handle component configured to allow interchangeability of the handle. For example, different handle components which are suitable for different climates or uses or environmental conditions may be provided.

To facilitate connection of a handle to the tang, the kit of parts may also comprise adhesive and/or screws.

Prior art hollow handle knives are limited in handle design and material and also in strength and integrity, as a result of their construction. The knife of this invention is versatile, having a hollow storage area incorporated therein whilst also having the advantages of a strong and robust knife, which may be any shape or style. The knife of the present invention may be lightweight and balanced and need not be restricted to a certain length or thickness.

By way of example only, one specific embodiment of knife of this invention will now be described in detail, reference being made to the accompanying drawings in which:—

Figure 1:
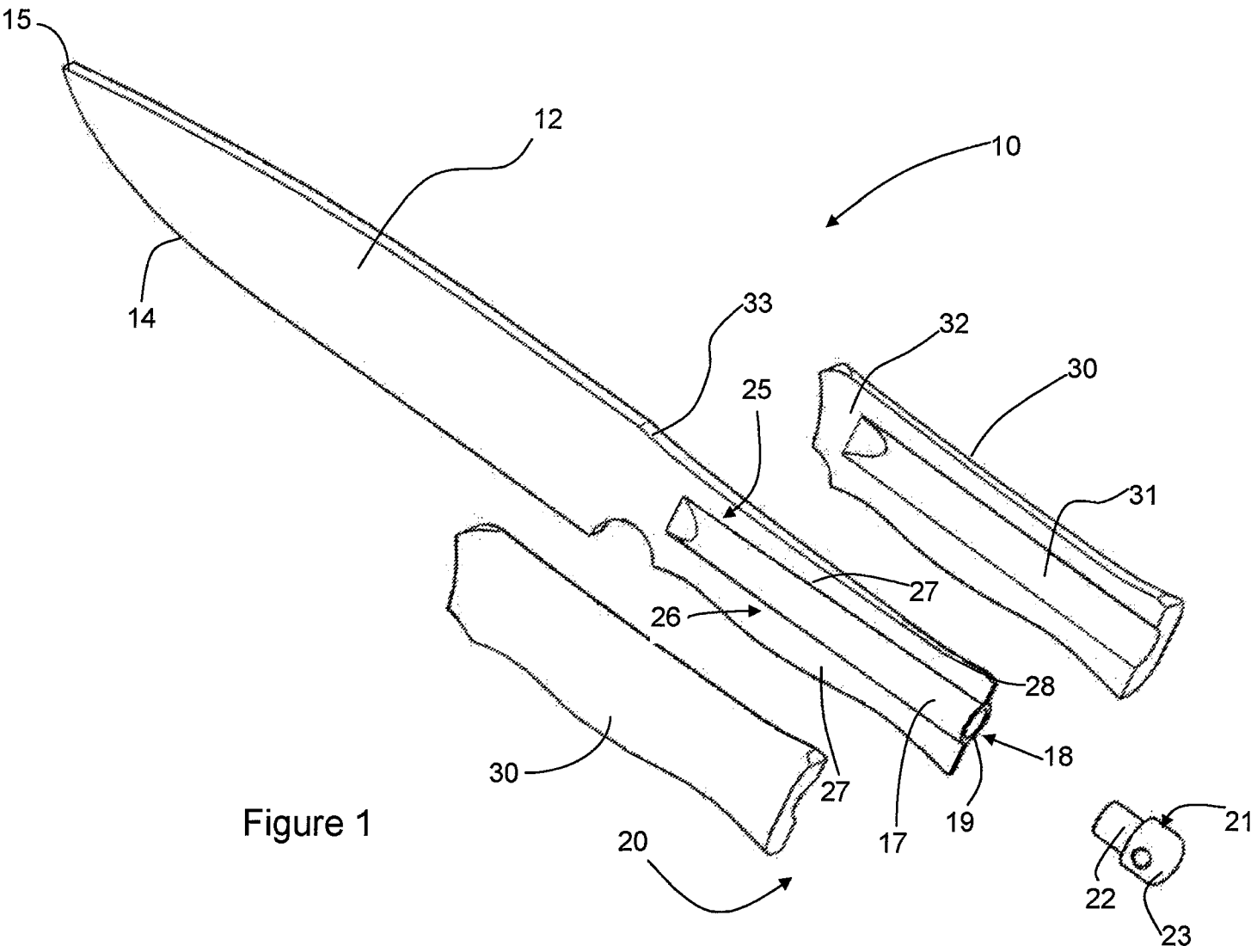
FIG. 1 is an exploded perspective view of a first embodiment of knife according to this invention.
Figure 2:
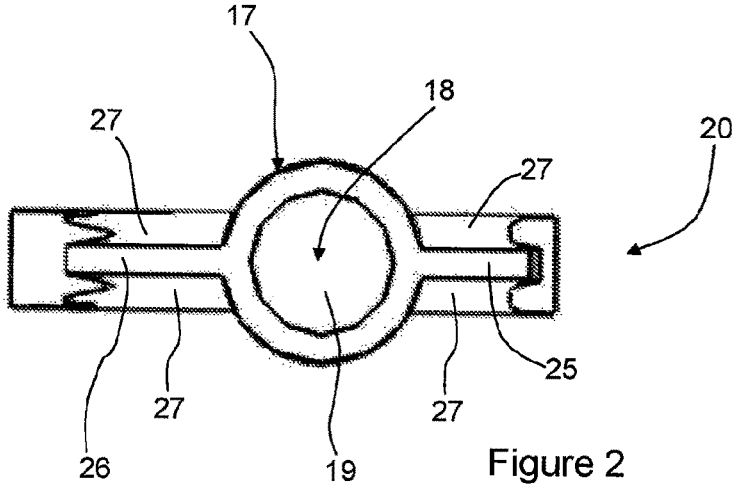
FIG. 2 is an end view of the knife of FIG. 1 without the handle components.
Figure 3:
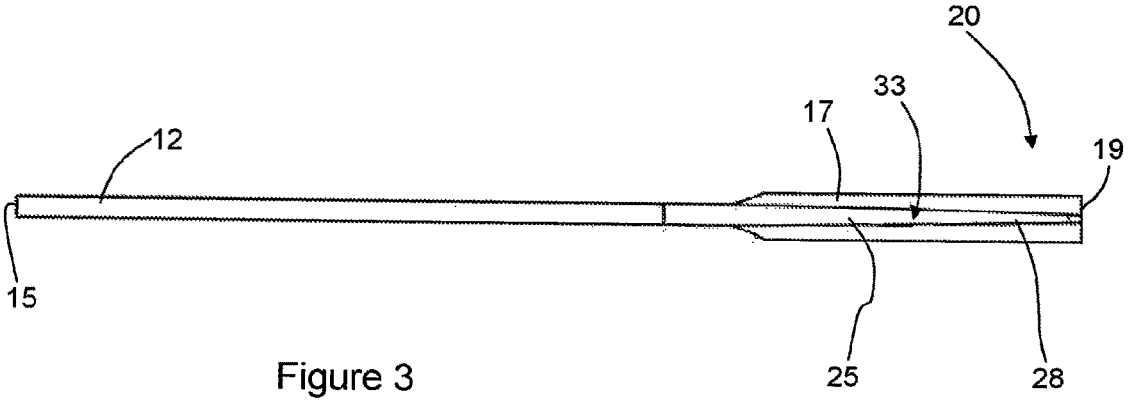
FIG. 3 is a side view of the knife of FIG. 1 without the handle components.

Referring initially to FIGS. 1 to 4, there is shown a knife 10 including a blade 12 and a handle 13 for gripping. The blade 12 has a cutting edge 14 and a tip 15. The shape of the blade 12 of this invention is not limited to that shown and indeed is primarily dependent upon the intended purpose of the knife 10; various different shapes and designs of blade exist and may equally be used.

Extending axially from the blade 12 is a substantially tubular cylindrical tang 17. The tang 17 is integral to the blade 12 and is hollow with an internal recess 18 to provide a storage area for securing items, such as matchsticks. The recess 18 is accessed through an opening 19 formed in the end 20 of the tang remote from the blade 12. An end cap 21 is provided to close the opening 19. The end cap 21 has an engaging portion 22 to be inserted in the opening 19 and a gripping portion 23 which extends from the opening 19 to facilitate insertion and removal of the end cap 21. The engaging portion 22 and the opening 19 are configured such that the end cap 21 may be frictionally engaged in the opening 19.

Two ribs 25, 26 project outwardly from opposed sides of the tang 17 and these ribs 25, 26 are integral to the blade 12 and the tang 17. In this embodiment the ribs 25, 26 extend along the length of the tang 17. Each rib 25, 26 is generally planar defining two opposed flat surfaces 27 (only one visible on each rib in the Figures) and are shaped and configured to form a handle profile with an upper rib 25 arranged to embrace the palm of a hand and a lower rib 26 to conform to the fingers. The upper rib 25 has a curved profile and the lower rib has an undulating profile. Each rib 25, 26 tapers towards the tang end 20 to form a narrow region 28 at that end 20.

Figure 4:
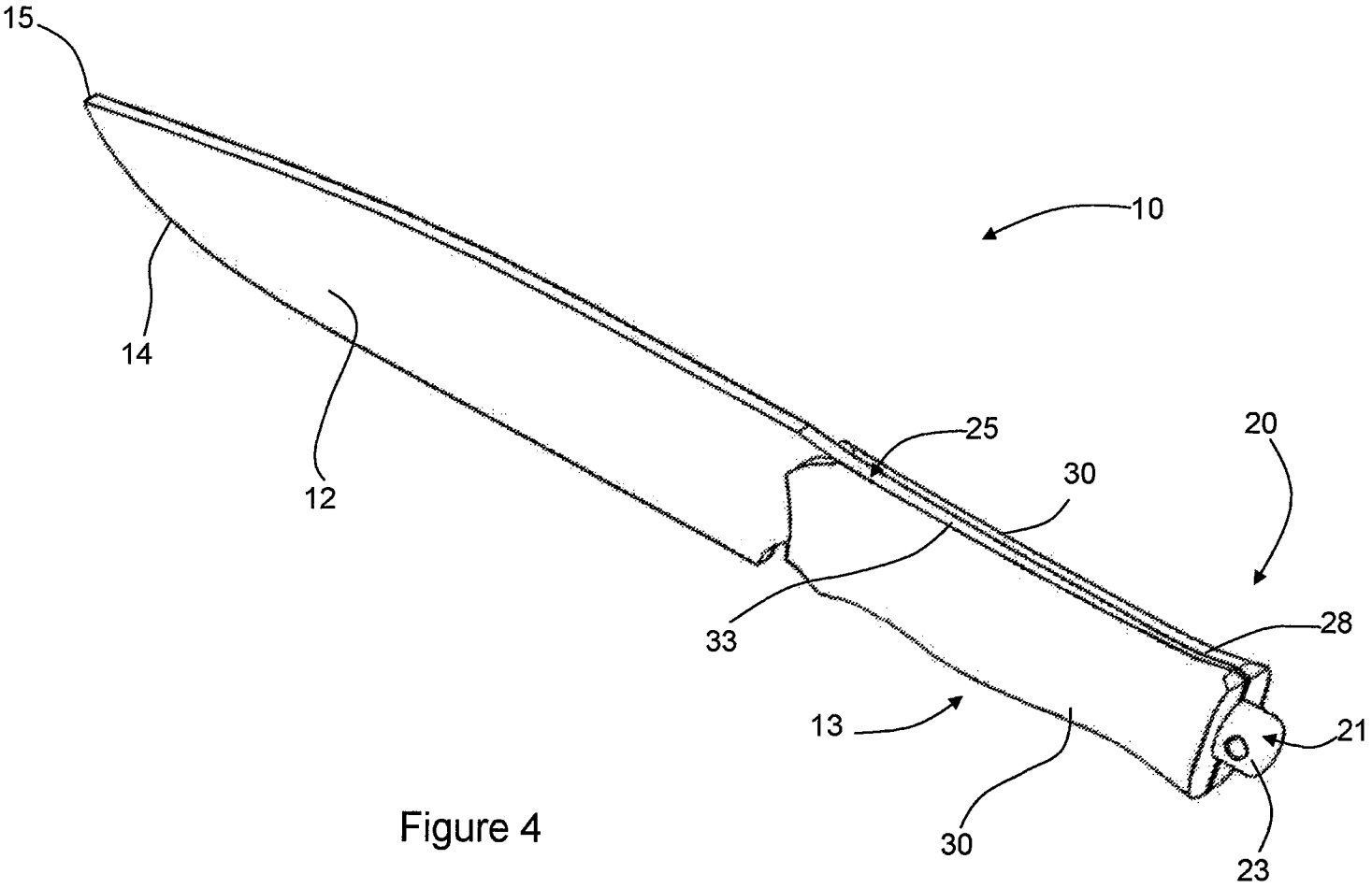
FIG. 4 is a perspective view of the first embodiment of the knife of the present invention.

The handle 13 is formed from two separate components 30, as best seen in FIG. 1. The handle components 30 each have an inwardly directed face which corresponds to the shape and configuration of the cylindrical tang by having a semi-circular channel 31 formed therein. A ledge 32 is formed around three sides of the channel 31 and this ledge 32 is arranged to embrace the flat surfaces 27 of the ribs 25, 26. As best seen in FIG. 4 the tapering edge 33 of each rib 25, 26 is visible when the handle components 30 are connected.

Externally the handle 30 looks like any conventional knife handle.

The knives of the second, third and fourth embodiments differ from the first embodiment in the shape and configuration of the ribs and handle. In view of this, like parts having the same function in the four embodiments will be given the same reference numbers and will not be described again in detail here.

Figure 5:
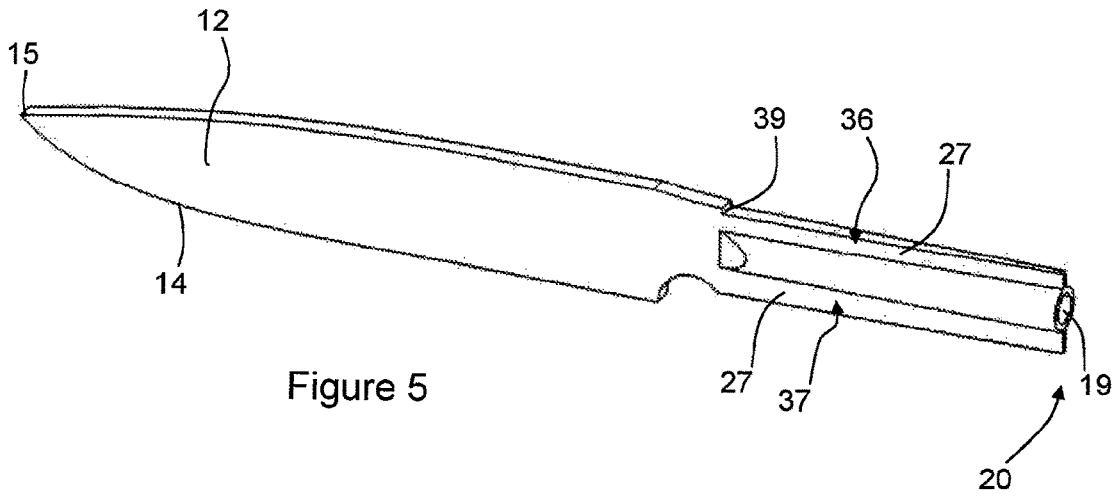
FIG. 5 is a perspective view of a second embodiment of knife of the present invention without the handle components.
Figure 6:
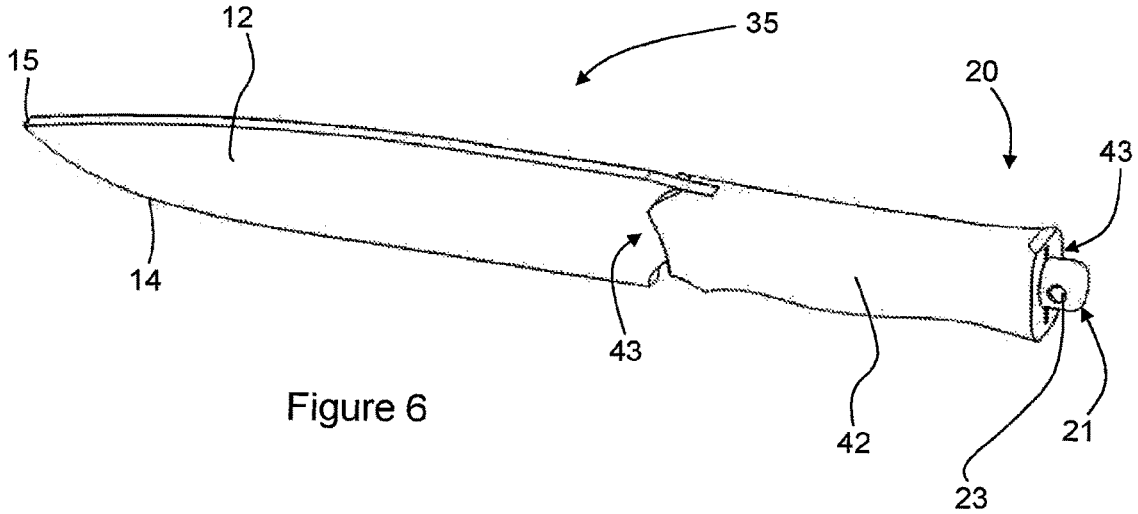
FIG. 6 is a perspective view of the knife of the second embodiment.

The second embodiment of knife 35 is shown in FIGS. 5 and 6. The ribs 36, 37 have two opposed flat surfaces 27, as with the first embodiment and also taper towards the tang end 20. The ribs 36, 37 of this embodiment are arranged to be hidden from view when the handle 42 is attached. The lower rib 37 projects from the tang 17 to a lesser extent than the lower rib 26 of the first embodiment. The handle 42 of this embodiment is a single component having an internal face corresponding to the shape and configuration of both the tang 17 and the ribs 36, 37 and having an opening 43 formed in both ends to enable location of the handle 42 over the tang end 20 of the knife 35 and also to provide access to the tang opening 19. In this embodiment the handle 42 engages an abutment surface 39 when located on the knife 35 by axial movement of the handle 42 over the tang 17.

Figure 7:
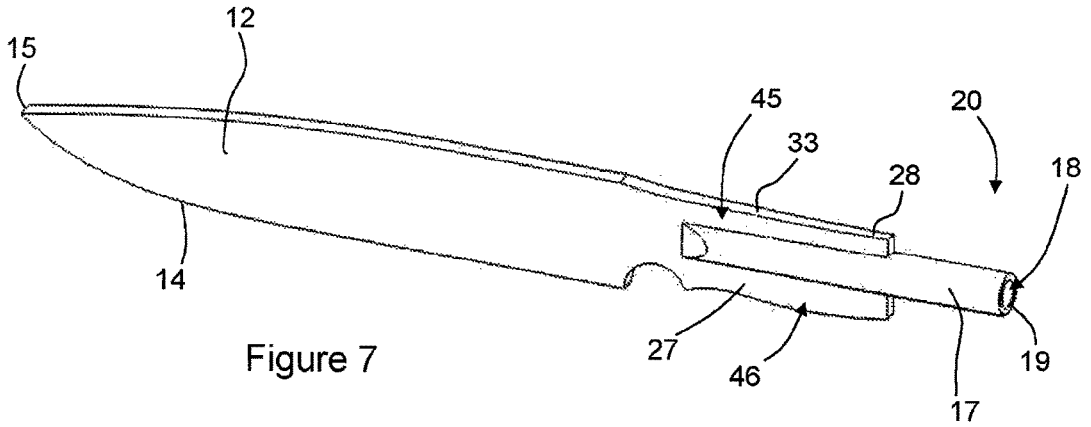
FIG. 7 is a perspective view of a third embodiment of knife of the present invention without the handle components.
Figure 8:
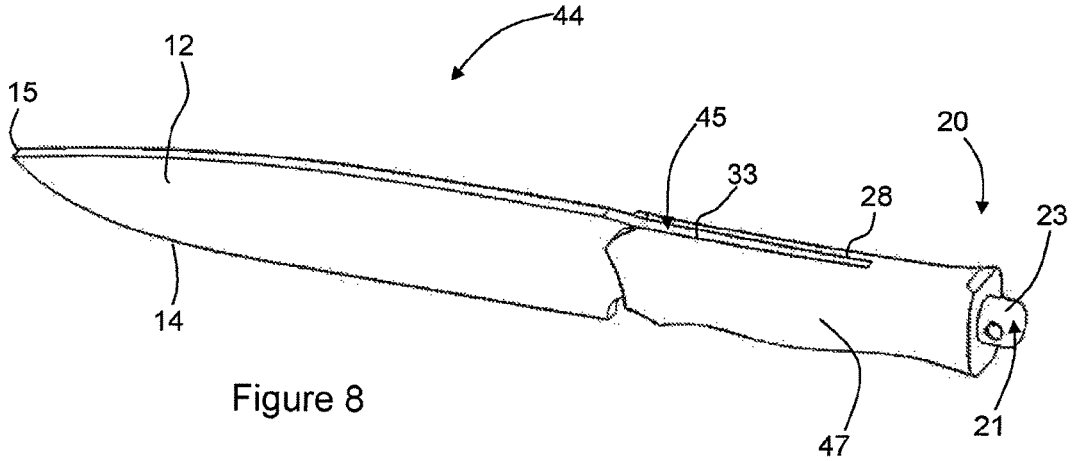
FIG. 8 is a perspective view of the knife of the third embodiment.

FIGS. 7 and 8 show a third embodiment of knife 44 and this is the same as the first embodiment except that the ribs 45, 46 extend only part way along the tang 17. This arrangement may be useful where less weight is required at the tang end 20 of the knife 44. The handle 47 of this embodiment is a single component, similar to the handle 42 of the second embodiment but having a bifurcated profile to enable the ribs 45, 46 to be visible when the handle 47 is connected.

Figure 9:
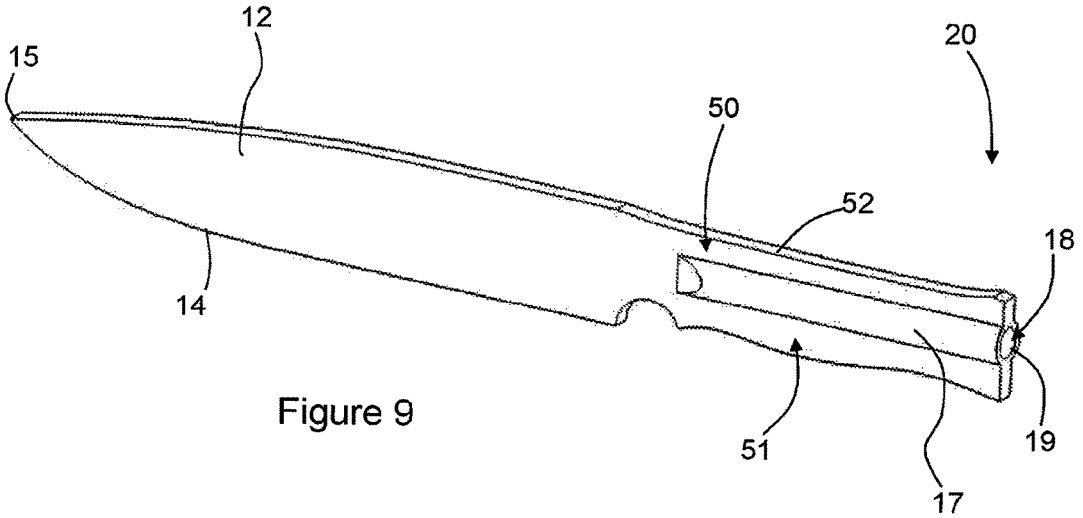
FIG. 9 is a perspective view of a fourth embodiment of knife of the present invention without the handle components.
Figure 10:
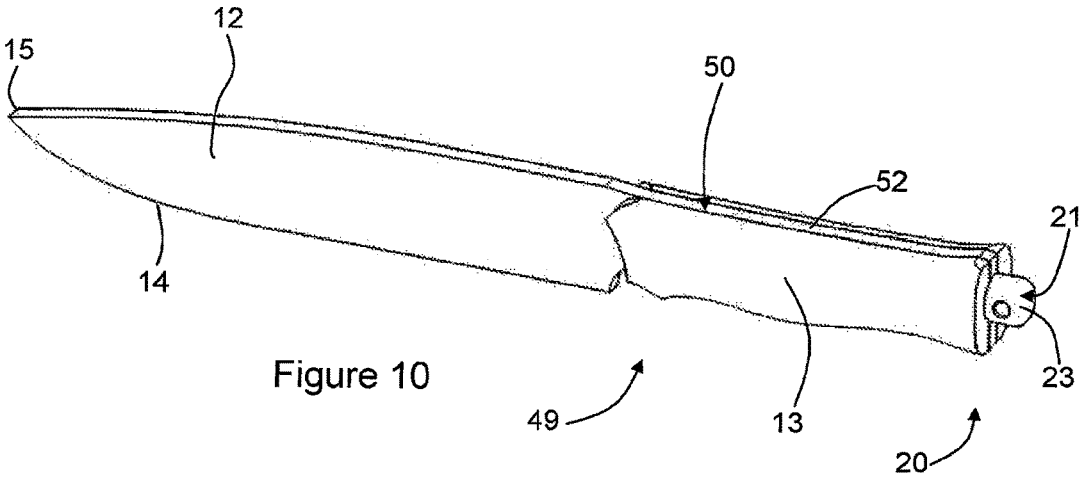
FIG. 10 is a perspective view of the knife of the fourth embodiment.

The fourth embodiment of knife 49 shown in FIGS. 9 and 10 is similar to the first embodiment except that the ribs 50, 51 do not taper towards the tang end 20; rather the ribs 50, 51 do not narrow at all along the length of the tang 17 and define a consistent edge 52.

The invention claimed is:

1. A knife comprising:

a blade;

a hollow tang integral with the blade such that the hollow tang extends from the blade and is one-piece with the blade, the hollow tang having an open end and configured to accommodate items therein;

at least one rib projecting outwardly from at least part of the hollow tang, the at least one rib extending axially at least part way along the tang; and one or more separately formed handle components mounted on the tang and connected to the at least one rib.

2. A knife as claimed in claim 1 wherein the at least one rib and the hollow tang are integral.

3. A knife as claimed in claim 2, wherein the at least one rib is defined as an extension of the blade.

4. A knife as claimed in claim 1, wherein the hollow tang is generally annular in cross section.

5. A knife as claimed in claim 1, wherein the at least one rib is substantially elongate.

6. A knife as claimed in claim 5, wherein the at least one rib tapers towards an end thereof remote from the blade.

7. A knife as claimed in claim 1, wherein the at least one rib comprises two ribs projecting from opposed parts of the tang.

8. A knife as claimed in claim 1, wherein a shape and configuration of an inside face of the one or more handle components is complementary to the tang such that at least part of the at least one rib is exposed.

9. A knife as claimed in claim 1, wherein a shape and configuration of an inside face of the one or more handle components is complementary to the tang and the at least one rib.

* * * * *